United States Patent [19]

Klinkhammer et al.

[11] Patent Number: 4,777,670

[45] Date of Patent: Oct. 18, 1988

[54] UNDER-THE-RIM DISPENSING UNIT

[75] Inventors: Michael E. Klinkhammer; Mark E. Wefler, both of Racine, Wis.

[73] Assignee: S. C. Johnson & Son, Inc., Racine, Wis.

[21] Appl. No.: 143,906

[22] Filed: Jan. 13, 1988

[51] Int. Cl.[4] ..... E03D 9/02

[52] U.S. Cl. ..... 4/231; 4/222; 4/223; 4/309; 422/263; 422/266; 422/275

[58] Field of Search ..... 4/231, 224, 222, 223, 4/309, 261, 222.1; 222/434, 438; 422/5, 263, 266, 275

[56] References Cited

U.S. PATENT DOCUMENTS

| | | | |
|---|---|---|---|
| D243,850 | 3/1977 | Davenport | D23/208 |
| 1,067,472 | 7/1913 | Creed | 4/231 |
| 1,880,912 | 10/1932 | Duwelius | 4/231 |
| 3,529,309 | 9/1970 | Leavitt et al. | 4/231 |
| 3,588,926 | 6/1971 | Buck, Jr. | 4/231 |
| 3,766,576 | 10/1973 | Ancel | 4/231 |
| 4,096,593 | 6/1978 | Vlahakis | 4/231 |
| 4,168,551 | 9/1979 | Hautmann et al. | 4/231 |
| 4,555,819 | 12/1985 | Weiss et al. | 4/233 |
| 4,615,054 | 10/1986 | Buecheler et al. | 4/231 |

FOREIGN PATENT DOCUMENTS

| | | | |
|---|---|---|---|
| 2159 | 10/1931 | Australia | 4/231 |
| 92283 | 10/1983 | European Pat. Off. . | |
| 2603585 | 8/1977 | Fed. Rep. of Germany . | |
| 2947546 | 6/1981 | Fed. Rep. of Germany | 4/231 |
| 379553 | 9/1932 | United Kingdom . | |
| 2098253 | 11/1982 | United Kingdom . | |

OTHER PUBLICATIONS

Package Label, "Johnson Laser Desodorante Continuo De Pocetas", S. C. Johnson & Son de Venezuela, C.A., 1986, No. 480021.

3 Color Photographs of Johnson Laser Product, various views, Package Label "Johnson Purific Desodorizador Sanitario", Companhia Ceras Johnson, Brazil, No. 1CS01.

Package Label, "Johnson Wax Befresh! Toilet Bowl Freshener Deodorizer", S. C. Johnson & Son, Inc., Racine, WI, 1980, No. 469383.

*Primary Examiner*—Henry K. Artis

[57] ABSTRACT

A dispenser for dispensing a dissolvable product into a toilet bowl. The structure of the dispenser properly meters and times the flow of water therethrough to increase operational efficiency. The dispenser includes a substantially sealed container enclosing the product and having an entrance hole and an exit hole. Water flow interruptions are positioned to interrupt the flow of flush water and to channel the water to the entrance. A sufficient change of water is guaranteed by the deflectors while excess water is limited by the size of the entrance. A deflector is positioned to deflect water away from the product, and instead to cause the water to rise gently in the containers. The size of the exit hole ensures that water remains in the container after flushing has stopped, so that the dissolved product is efficiently infused into the water standing in the toilet bowl as the water level in the container recedes.

31 Claims, 2 Drawing Sheets

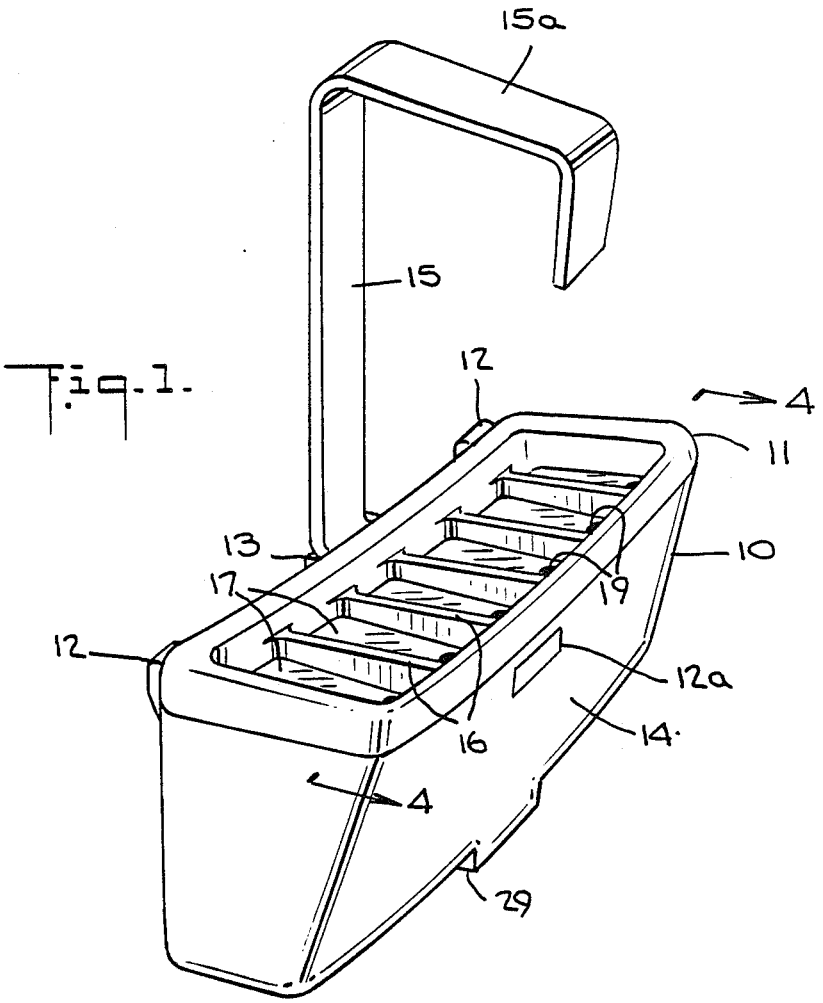
Fig. 1.
Fig. 2.
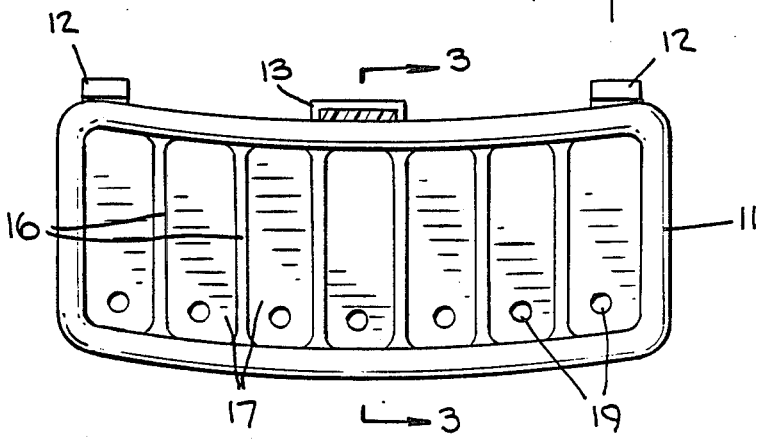

UNDER-THE-RIM DISPENSING UNIT

BACKGROUND OF THE INVENTION

1. Field of the Invention

The present invention pertains generally to a device for dispensing a product into a toilet bowl, and particularly to a device adapted to be hooked under the rim of a toilet bowl to interrupt the flow of flush water as the toilet is flushed and to dispense the product directly into the toilet bowl.

2. Description of the Related Art

Dispensers for dispensing a dissolvable product into a toilet bowl from a hanging position under the rim of the toilet bowl are, in general, known. Such dispensers are suspended within the bowl where they interact with the flush water to infuse the water standing in the bowl after the flush is completed with a dissolved product. Typically, the product is a deodorant, a disinfectant, or a bleach to clean the toilet. Additionally, a dye or colorant may be combined with the product to produce a pleasing effect.

In conventional dispensers, the product is generally held within a cage supported under the rim of the toilet, thereby to expose the product to flush water as it flows from the cistern to bowl. However, such a cage disadvantageously allows the product to be dissolved during the entire flushing operation, and therefore allows great amounts of the product to be wasted by being flushed down the toilet. Moreover, since the product is exposed to the entire flush cycle, the life of the product is unnecessarily shortened.

It has also been proposed to use a siphon in a lower closed compartment of the dispenser. See, for example, U.S. Pat. No. 4,168,551 to Hautmann, and 4,555,819 to Weiss. The siphon is said to prevent staining on the side of the bowl by positively stopping the flow of dissolved product and water from the closed compartment when the prime in the siphon is lost. Such devices are still vulnerable to a variety of drawbacks. Primarily, since prior art devices ignore the problem of waste, the siphon often operates during the flush operation, and the siphon prime may be lost prior to termination of the flushing operation. Thus, a large proportion of product is simply flushed out of the toilet.

Second, many such devices have open cages and therefore suffer from high waste and short life of the product as previously discussed. On the other hand, in those devices having a completely closed compartment, the product often sits in a pool of water between operations. Thus, the amount of discharged product is inconsistent from operation to operation since different concentrations of dissolved product result from different times between flush operations. That is, higher amounts of product are discharged as the time between operations increases.

Finally, since the siphon must be primed, there are occasions where the device fails to operate altogether, since an insufficient amount of water enters the compartment to prime the siphon.

SUMMARY

It is an object of the present invention to overcome the disadvantages found in conventional devices in a simple device which provides long product life, positive infusion of product into the water, consistent concentrations of dissolved product, and low waste of the product.

The dispenser of our invention realizes its objects by properly timing and metering the amount of water admitted to the dispenser and the amount of water flowing from the dispenser. Proper timing and metering approximates ideal operation of such a dispenser. In ideal operation, the dispenser controls both the water admitted to the device and the water flowing from the device. Initially, an ideal dispenser completely fills with water as the toilet is flushed. After completely filling, the ideal dispenser admits no additional water. The operation of the dispenser is then suspended until the flush operation has ceased, during which time the product dissolves in the water within the dispenser. After flushing has ceased, the dispenser then releases the dissolved product and water.

Operation in this manner eliminates waste of the product by preventing dissolved product from being flushed from the toilet during the current flush cycle. Further, waste is eliminated by preventing flush water from washing freely over the product. Moreover, since the water in the dispenser is in contact with the product for a known, repeatable interval, the concentration of the product released into the toilet is constant. Finally, releasing the water and dissolved product after the flush operation ensures that the device always functions.

In one aspect, our invention approximates ideal operation and achieves its objects by the provision of a substantially sealed container having at least one entrance for water on an upper surface thereof and at least one exit opening disposed in a lower portion thereof to permit water to exit the container. Water flow interruptors are positioned to interrupt the flow of flush water and to channel the water to the entrance. A sufficient charge of water into the dispenser is guaranteed by the flow interruptors. A deflector is positioned to deflect water away from the product as it enters the dispenser. Thus, instead of directly contacting the product as the water enters the container, the entering water gently rises around the product.

By gently rising around the product, the water only slowly dissolves the product, and, in fact, a greater proportion of the product is dissolved as the water level within the container recedes as it is expelled from the exit opening in the lower portion of the container after the toilet has ceased flushing. This delayed dissolution allows most of the product to be expelled after the flush operation has terminated. The deflector and the closed container increase the life of the product by preventing water from directly washing over the product, and consistent concentrations of dissolved product are ensured by the gentle, predictable dissolution of the product as water recedes in the container.

In another aspect, our invention achieves its objects by relating the size of the entrance and the exit opening in the container. The entrance size is selected so that only a limited amount of water is allowed to enter the dispenser. The exit opening size is selected so that egress from the container continues after the flush operation has ceased. Since only a limited amount of water enters the dispenser, consistency of the product concentration is improved; since egress of water continues after the flush operation ceases, when the greater amount of product is dissolving, product waste by being flushed down the toilet is virtually eliminated.

In the embodiment described herein, the deflectors and the entrance are combined by providing the entrance at one side of the dispenser so that the water enters the dispenser and runs down the side of a wall of the container without contacting the product. As before, the water rises gently and surrounds the product so that more of the product is dissolved as water recedes within the container rather than as the water rises.

Certain aspects of our invention have been outlined rather broadly so that the detailed description which follows may be more readily and better understood. There are, of course, additional features of the invention that will be described and which will form the subject of the claims appended hereto. Those skilled in the art will appreciate that the principle upon which this disclosure is based may readily be utilized as a basis for designing other structures for carrying out the several purposes of the invention. It is important, therefore, that the claims be regarded as including such equivalent constructions as do not depart from the spirit and the scope of the invention.

BRIEF DESCRIPTION OF THE DRAWINGS

Specific embodiments of the invention have been chosen for the purpose of illustration and description, and are shown in the accompanying drawings, which form a part of this specification.

FIG. 1 is a perspective view of the device shown with a hanger for hanging the dispenser under the rim of a toilet bowl.

FIG. 2 is an elevational view of the dispenser.

DESCRIPTION OF THE PREFERRED EMBODIMENT

Figure 3:
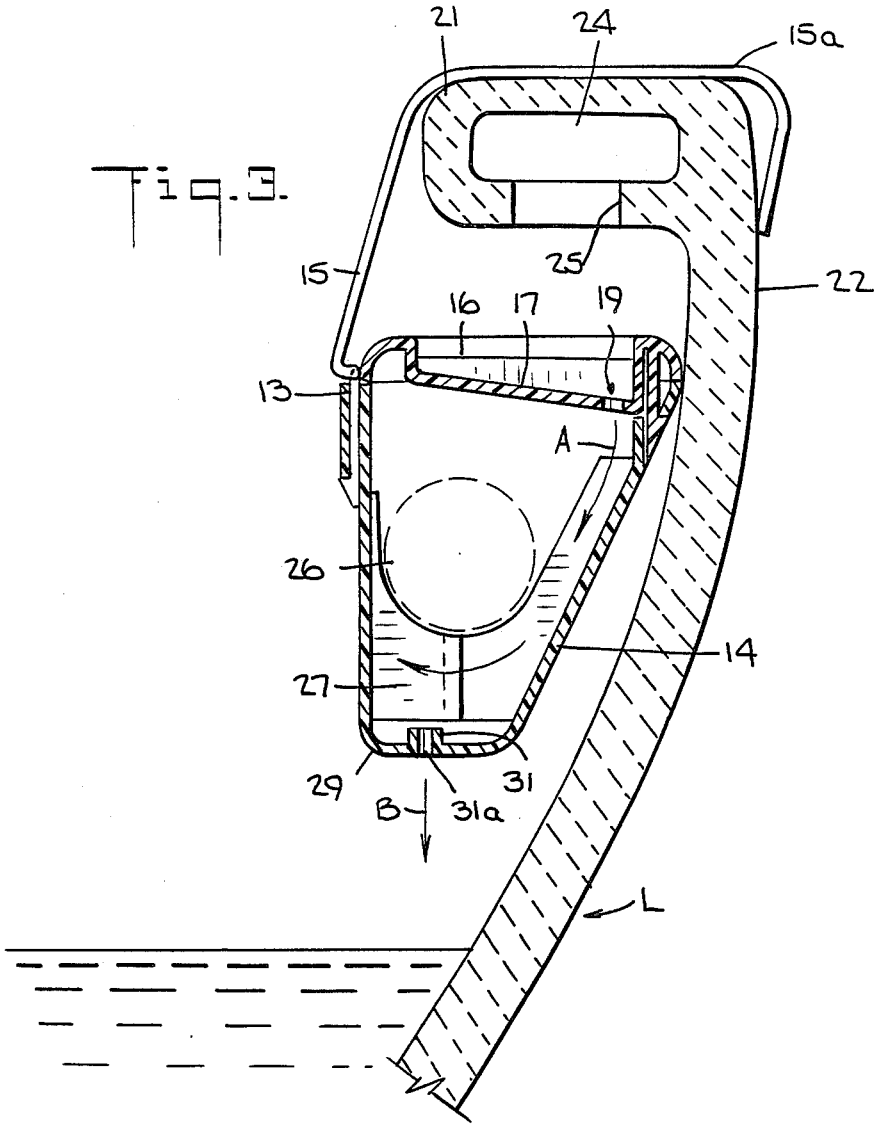
FIG. 3 is a cross-sectional view of the dispenser taken along the line 3—3 in FIG. 2, and shown in place under the rim of a toilet.

Referring to FIG. 1 a dispenser according to our invention is formed from a housing 10 having an open top which is covered by cover 11. The cover is fixed to the housing by a pair of hinges 12 and by a clasp 12*a* on the opposite side of the cover. The housing and the cover form a closed container for the dispenser, yet allow the product to be replaced when it has been completely dissolved.

As seen in FIG. 2, the housing of the dispenser is somewhat curved to allow side 14 of the dispenser to closely fit against the inside of the toilet bowl. Side 14 also slants inwardly as it progresses downwardly so that the housing becomes narrower at its lower extremity.

Hanger 15 is removably attached to the dispenser by band 13. The hanger has a hook 15*a* which permits the dispenser to be hung within the toilet bowl from the rim of the bowl. Ribs 16 are formed in cover 11, and rise to a level somewhat below the top of cover 11. The ribs serve to interrupt the flow of water as water moves longitudinally along the length of the dispenser. The ribs form a series of channels 17 which slope downwardly to the right as viewed in FIG. 1, and to the bottom as viewed in FIG. 2. As further seen in FIG. 2, entrance holes 19 are formed in the deep end of each of the channels. The entrance holes allow water interrupted by the ribs and channelled by the channels to enter the dispenser at an off-center or deflected position.

FIG. 3 shows the dispenser in place under the rim 21 of toilet bowl 22. Typically, the rim of the toilet will have a passage 24 formed at the center thereof with a plurality of holes 25 extending from the passage. The passage guides water from the cistern to the rim of the bowl where the water is discharged from holes 25 in a swirling, partially horizontal trajectory.

Figure 4:
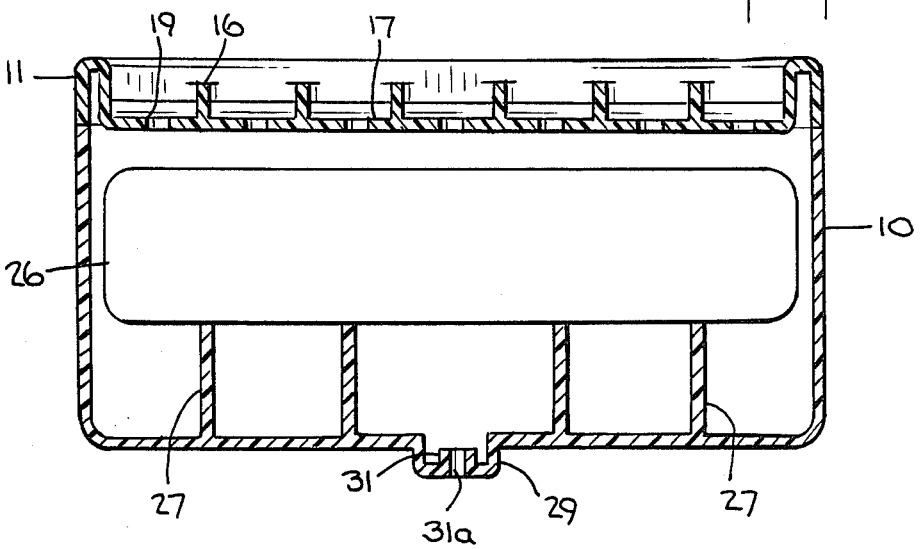
FIG. 4 is a cross-sectional view of the dispenser taken along the line 4—4 in FIG. 1.

FIG. 3 also shows product 26 suspended within the dispenser above the bottom of housing 11 by supports 27. As shown in FIG. 4, plural supports are provided along the length of the product to prevent the product from falling to the bottom of the housing as dissolution of the product decreases its size.

As shown in FIG. 4, well 29 is also formed in the bottom of the housing. A short tube 31 is disposed at the center of the well and forms exit hole 31*a*. The tube extends upwardly into the well but does not rise above the level of the bottom of the housing. The well and the tube accumulate residual dripping from the product after a flushing operation, and the upward extension of the tube prevents the accumulated drippings from dripping from the dispenser into the toilet. As shown in FIG. 3, the tube is located off-center, near the inner side of the dispenser. This position allows water to exit from the dispenser at a point where the normal water level rises within the toilet bowl. Therefore, water exiting from the dispenser is delivered directly to standing water in the bowl, and does not run down the side of the toilet bowl. Consequently the dissolved product does not stain the inside of the bowl.

The dimensions and the material of the dispenser should be carefully chosen for proper operation of the dispenser. Only an amount of water approximately equal to the volume of the container should be permitted to enter; and water should exit from the container slowly enough so that most of the dissolved product is expelled after the toilet has finished flushing. Additionally, the material of tube 31 and the size of hole 31*a* should be selected so that residual drips from the dispenser are substantially suppressed. We have found that six ribs spaced about 0.360 inches apart and forming seven channels in the cover to be acceptable. The ribs should be approximately 0.15 inches high at the shallow end of the channel, increasing to approximately 0.23 inches at the deep end of the channel. The seven entrance holes may be approximately 0.140 inches in diameter. The volume of the container should be approximately 70 milliliters. The combined effect of the height of the ribs and the diameter of the entrance holes ensures that sufficient water (that is, approximately 70 ml.) is interrupted and channelled into the container to fill the container gently with water.

We prefer that the housing and the cover be formed from polypropylene, primarily due to the ease with which this material may be molded into the desired shape and its inherent strength characteristics. The exit hole 31*a* may be approximately 0.078 inches in diameter, and tube 31 may extend approximately 0.093 inches into the well. The surface tension and contact angle of water on polypropylene combined with these dimensions substantially prevent undesired residual dripping from the dispenser.

Operation of the dispenser will be described with reference to FIG. 3. As water is ejected from holes 25 in the underside of the rim of the toilet, its swirling, partially horizontal trajectory is interrupted by ribs 16 as the water flows thereover. The interrupted water flows down the inclined channels and enters the container through entrance holes 19, as shown schematically by arrow A. Since the the water has been deflected by the off-center location of holes 19, the water runs down the side 14 of the housing rather than directly washing over product 26. As water continues to be directed into the container, it gently rises within the container and begins to dissolve product 26.

It will, of course, be apparent that deflection of water to prevent direct washing over the product may be accomplished by other structures. For example, rather than forming a deflector by off-centering the entrance holes, the product may simply be displaced relative to the entrance holes. As a further example, each channel 17 may be molded level or sloped toward the center instead of being sloped to one side. A slot may be formed at the center of each such channel. An inclined plate disposed under these slots would then be provided to deflect water away from the product and to allow the water to rise gently around the product.

As the water rises within the container, it is simultaneously expelled through exit hole 31*a*, as shown schematically by arrow B. However, at this point of operation, only a small amount of product has been dissolved, and consequently only a small amount of dissolved product is flushed down the toilet drain.

Eventually, water stops flowing from the rim of the toilet and settles to a level indicated by arrow L in the toilet bowl. Since no more water now enters the container, the water level within the container begins to recede as water drains through hole 31*a*. Most of the dissolution of the product occurs as the water level recedes past the surface of the product. Thus, most of the dissolved product is released from the container after the flush is completed, and therefore most of the dissolved product remains in the toilet bowl rather than being flushed down the toilet drain.

After the container has emptied, residual water remaining on the product and on the walls of the container slowly drips to the bottom of the container. This residual water is collected in well 29 and is substantially prevented from dripping out of the dispenser by the surface tension and contact angle of the water in combination with the diameter of exit hole 31*a*. However, any water which does drip from the dispenser strikes the water in the bowl rather than the side of the bowl due to the inward displacement of hole 31*a*. Thus, staining of the bowl is substantially prevented.

A dispenser according to our invention and substantially as described above was fabricated with a clear top to observe operation of the dispenser and to test the efficiency of the dispenser.

With the clear top, delayed dissolution of the product was visually verified. While the precise reason for the delayed dissolution is not entirely understood, we believe the delay results from two factors. First, water must be infused into the surface of the product before dissolution will begin. The water infusion stage occurs while water rises gently within the container. Second, when the water level recedes in the container, turbulence appears to be generated in the water around the surface of the block. The turbulence generates sufficient motion in the water to cause most of the product to be dissolved as the water level recedes. This theory is supported by the observation of concentrated trails of dissolved product streaming from the surface of the product as the water level recedes within the container.

The operation of this dispenser was compared in a series of laboratory tests with a conventional device. The conventional device selected was substantially as illustrated and described in the aforementioned U.S. Pat. No. 4,168,551 to Hautmann, except that the product was suspended at a position within a solid-walled portion of the device below an open cage portion. Such a dispenser is sold commercially and is known as a Harpic Fresh dispenser.

Both dispensers were tested by suspending the dispensers within the toilets as illustrated in FIG. 3. A 9 gram sample of dissolvable product known commercially as "Toilettes Fraiches" was placed in each dispenser. This product is strongly dyed blue and allows simple observation of the efficiency of the dispenser by observing the intensity of this color in the toilet bowl water after a flush operation. The intensity was precisely quantified by checking a sample of the water on an ultraviolet analyzer at 630 nanometers.

The dispensers were tested in a European-style toilet with a water temperature controlled to 80 degrees fahrenheit. The toilet was flushed at six minute intervals for eight hours, and at 90 minute intervals to permit continuous overnight operations and to observe the effect of varying the time between flushes. Water samples were drawn from the bowl at approximately every tenth operation, and the sample was checked for blue intensity as described above. The dispensers were tested in this manner continuously until the product was completely dissolved. Although the dispensers were tested sequentially in the same toilet, the results of the test are given side-by-side in Table I for comparison purposes.

TABLE I

| Conventional Dispenser | | New Dispenser | |
|---|---|---|---|
| Flush # | Intensity | Flush # | Intensity |
| 1 | .001 | 1 | .027 |
| 11 | .035 | 11 | .031 |
| 28 | .073 | 21 | .033 |
| 35 | .033 | 34 | .027 |
| 47 | .025 | 49 | .017 |
| 58 | .003 | 60 | .017 |
| 65 | .037 | 69 | .019 |
| 77 | .025 | 73 | .025 |
| 81[1] | .033 | 81[1] | .027 |
| 92[2] | .263 | 91[2] | .017 |
| 105 | .039 | 104 | .051 |
| 114 | .007 | 114 | .043 |
| 123 | .081 | 123 | .031 |
| 137 | .011 | 132 | .025 |
| 149 | .023 | 146 | .023 |
| 156 | .009 | 156 | .021 |
| 171 | Finished | 162 | .039 |
| Average intensity (excluding extremes) = .0335 | | 170[3] | .023 |
| | | 177 | .025 |
| | | 184 | .031 |
| | | 194 | .019 |
| | | 202 | .015 |
| | | 216 | .015 |
| | | 222 | .017 |
| | | 232 | .031 |
| | | 242 | .021 |
| | | 255[3] | .009 |
| | | 264 | .005 |
| | | 292 | Finished |
| | | Average intensity (excluding extremes) = .0242 | |

NOTES:
[1]Last flush at six minute intervals
[2]Last flush at 90 minute intervals
[3]Overnight break in six minute flush intervals Initially, the most obvious difference between the dispensers is that the product in a dispenser according to our invention lasted for more than 290 flushes, while in a conventional device the product lasted for only about 170 flushes. To allow for the larger average intensity of product dispensed by the conventional dispenser, these 170 flushes may be proportionally increased to 237 flushes. Even so, the new dispenser is more than 23% (292 divided by 237) more efficient than a conventional device in preventing waste of the product.

Moreover, the consistency of the concentration of dissolved product remaining in the bowl was far inferior in the conventional device. The range of intensity (maximum to minimum) for the conventional device was 0.262, or approximately six times more random than the 0.046 range of the new dispenser. The worst fluctuations in the concentration for the conventional dispenser were observed in the overnight runs when long periods of standing in a pool of water dramatically increased the intensity of the dissolved product. However, other factors contributed to this variation. For example, at samples 58 and 114, the siphon in the conventional dispenser failed to prime or primed too early in the flushing cycle, thereby dramatically lowering the intensity of dissolved product in the bowl.

While a preferred embodiment of our invention, and indeed the best embodiments known to us, has been described in detail, it should be understood that the invention should not be limited to any specific structure described above. Rather, the scope of the invention should be ascertained by reference to the following claims.

What is claimed is:

1. A dispenser for using a flow of water during a toilet flush to dispense a dissolvable product into a toilet bowl, said dispenser comprising:

a substantially sealed container for containing and releasing water, said container having an upper surface which includes an entrance permitting water to enter said container, said container also having an exit opening disposed in a lower portion thereof permitting water and dissolved product to be released from said container;

a holder for holding the dissolvable product in said container in a position to contact water contained in said container;

flow interruption means for interrupting the flow of water as it passes said dispenser and for channelling the interrupted flow of water toward said entrance; and a deflector for deflecting water as it initially enters said container through said entrance so that the initially entering water is substantially prevented from directly contacting the product, thereby delaying dissolution of the product.

2. A dispenser according to claim 1, wherein said holder holds the dissolvable product above a level of residual water contained in said container.

3. A dispenser according to claim 1, wherein said container comprises a housing and a removable cover.

4. A dispenser according to claim 3, wherein said cover is openable to allow replacement of the dissolvable product.

5. A dispenser according to claim 1, wherein said exit hole is sufficiently small to retain water within said container after the toilet has finished flushing.

6. A dispenser according to claim 1, wherein said exit opening is disposed in a well formed at the base of said container.

7. A dispenser according to claim 1, wherein said exit opening includes a tubular extension extending inside said container.

8. A dispenser according to claim 1, wherein said container includes a surface adapted to face toward the interior of the toilet, said exit opening being located closer to said surface than an opposing surface.

9. A dispenser according to claim 1, wherein said deflector is formed by relative displacement of said entrance and the product.

10. A dispenser according to claim 9, wherein said deflector causes water initially to contact an inside surface of said container, so that water flows down said inside surface and rises around the dissolvable product.

11. A dispenser according to claim 1, wherein dissolution of the product is delayed so that more product dissolves as water exits from said exit opening than when water enters said entrance.

12. A dispenser according to claim 1, wherein said flow interrupters comprise a plurality of ribs arranged substantially perpendicularly to the flow of water.

13. A dispenser according to claim 12, wherein said entrance comprises a plurality of holes formed within channels formed by said plurality of ribs.

14. A dispenser according to claim 13, wherein said deflector is formed by inclining said channels and by locating said holes to one side of said container.

15. A dispenser according to claim 1, wherein said entrance limits the amount of water entering said container to substantially the capacity of said container.

16. A dispenser for using a flow of water during a toilet flush to dispense a dissolvable product into a toilet bowl, said dispenser comprising:

a substantially sealed container for containing and releasing water, said container having an upper surface which includes an entrance permitting water to enter said container, said container also having an exit opening disposed in a lower portion thereof permitting water and dissolved product to be released from said container, said exit opening being sufficiently small to retain water within said container after the toilet has finished flushing:

a holder for holding the dissolvable product in said container in a position above a level of residual water contained in said container; and a plurality of ribs oriented to interrupt the flow of water as it passes said dispenser and to channel the interrupted flow of water toward said entrance;

wherein said entrance is disposed so as to deflect water as it initially enters said container so that the initially entering water is substantially prevented from directly contacting the product, thereby delaying dissolution of the product.

17. A dispenser according to claim 16, wherein said container comprises a housing and a removable cover.

18. A dispenser according to claim 17, herein said cover is openable to allow replacement of the dissolvable product.

19. A dispenser according to claim 16, wherein said exit hole is sufficiently small to maintain said container substantially filled with water until after the toilet has finished flushing.

20. A dispenser according to claim 16, wherein said exit opening is disposed in a well formed at the base of said container and includes a tubular extension extending inside said container.

21. A dispenser according to claim 16, wherein said container includes a surface adapted to face toward the interior of the toilet, said exit opening being located closer to said surface than an opposing surface.

22. A dispenser according to claim 16, wherein said entrance is located to cause water initially to contact an inside surface of said container, so that water flows down said inside surface and rises around the dissolvable product.

23. A dispenser according to claim 16, wherein dissolution of the product is delayed so that more product dissolves as water exits from said exit opening than when water enters said entrance.

24. A dispenser according to claim 16, wherein said ribs form an inclined channel and said entrance comprises a hole located at the deep end of said channel.

25. A dispenser according to claim 16, wherein said entrance limits the amount of water entering said container to substantially the capacity of said container.

26. A dispenser for using a flow of water during a toilet flush to dispense a dissolvable product into a toilet bowl, said dispenser comprising:

a substantially sealed container for containing and releasing water, said container including a housing and a removable cover, said cover having an entrance permitting water to enter said container, said housing having an exit opening disposed in a lower portion thereof adjacent an inwardly facing surface of said housing, said exit opening permitting water and dissolved product to be released from said container, said exit opening being sufficiently small to retain water within said container after the toilet has finished flushing;

a holder including a plurality of supports for holding the dissolvable product in said container in a position above a level of residual water contained in said container; and a plurality of ribs disposed in said cover and oriented to interrupt the flow of water as it passes said dispenser, said ribs forming an inclined channel for channelling the interrupted flow of water toward said entrance;

wherein said entrance is disposed at a lower portion of said inclined channel so as to deflect water as it initially enters said container so that the initially entering water contacts an inside surface of said housing and is substantially prevented from directly contacting the product, thereby delaying dissolution of the product.

27. A dispenser according to claim 26, wherein said exit hole is sufficiently small to maintain said container substantially filled with water until after the toilet has finished flushing.

28. A dispenser according to claim 26, wherein said exit opening is disposed in a well formed at the base of said housing.

29. A dispenser according to claim 26, wherein said exit opening includes a tubular extension extending inside said container.

30. A dispenser according to claim 26, wherein dissolution of the product is delayed so that more product dissolves as water exits from said exit opening than when water enters said entrance.

31. A dispenser according to claim 26, wherein said entrance limits the amount of water entering said container to substantially the capacity of said container.

* * * * *